US012065823B2

(12) United States Patent
Seery et al.

(10) Patent No.: US 12,065,823 B2
(45) Date of Patent: Aug. 20, 2024

(54) SYSTEMS AND METHODS FOR PROVIDING MODULAR BUILDING STRUCTURES BASED ON SITE-SPECIFIC CONDITIONS

(71) Applicant: SurePods, LLC, Orlando, FL (US)

(72) Inventors: William Seery, Westborough, MA (US); Marco Scanu, Piedmont, CA (US); Mark Jokerst, Astoria, OR (US)

(73) Assignee: SUREPODS, LLC, Orlando, FL (US)

( * ) Notice: Subject to any disclaimer, the term of this patent is extended or adjusted under 35 U.S.C. 154(b) by 0 days.

(21) Appl. No.: 17/884,451

(22) Filed: Aug. 9, 2022

(65) Prior Publication Data

US 2023/0048518 A1 Feb. 16, 2023

Related U.S. Application Data

(60) Provisional application No. 63/231,435, filed on Aug. 10, 2021.

(51) Int. Cl.

| | |
|---|---|
| ***E04B 1/348*** | (2006.01) |
| ***E04B 1/19*** | (2006.01) |
| ***E04B 1/26*** | (2006.01) |

(52) U.S. Cl.

CPC ..... *E04B 1/3483* (2013.01); *E04B 1/1903* (2013.01); *E04B 1/2604* (2013.01); *E04B 2001/2644* (2013.01)

(58) Field of Classification Search

CPC .... E04B 1/3483; E04B 1/1903; E04B 1/2604; E04B 2001/2644

See application file for complete search history.

(56) References Cited

U.S. PATENT DOCUMENTS

| | | | | |
|---|---|---|---|---|
| 4,974,386 | A * | 12/1990 | Eriksson | E04H 1/1238 312/111 |
| 9,382,709 | B2 | 7/2016 | Collins et al. | |
| 10,332,222 | B1 * | 6/2019 | Conboy | G06Q 30/0635 |
| 2011/0056147 | A1 * | 3/2011 | Beaudet | E04B 1/34869 52/79.9 |
| 2015/0211227 | A1 * | 7/2015 | Collins | E04B 2/7448 52/745.1 |
| 2016/0010355 | A1 * | 1/2016 | Bellve | E04H 9/024 52/79.5 |
| 2017/0328055 | A1 * | 11/2017 | Morales | E04B 1/3483 |
| 2019/0172160 | A1 * | 6/2019 | Conboy | B27K 3/20 |
| 2020/0240159 | A1 * | 7/2020 | Grada | E04H 1/02 |
| 2022/0364354 | A1 * | 11/2022 | Rafezy | E04B 1/3483 |

FOREIGN PATENT DOCUMENTS

| | | |
|---|---|---|
| CN | 106049669 | 10/2016 |

OTHER PUBLICATIONS

Official Action for Canada Patent Application No. 3170089, dated Nov. 8, 2023, 4 pages.

* cited by examiner

*Primary Examiner* — Rodney Mintz
(74) *Attorney, Agent, or Firm* — Sheridan Ross P.C.

(57) ABSTRACT

Systems and methods for providing modular building unit or "pods" are provided. In various embodiments, site-specific conditions and risk factors are evaluated and identified. The conditions and risk factors are used to inform decisions and design requirements for one or more pods and to modify or reinforce a pod prior to installation if needed. Methods and systems of securing the pods are also provided.

11 Claims, 12 Drawing Sheets

SYSTEMS AND METHODS FOR PROVIDING MODULAR BUILDING STRUCTURES BASED ON SITE-SPECIFIC CONDITIONS

This U.S. Non-Provisional patent application claims the benefit of priority of U.S. Provisional Patent Application Ser. No. 63/231,435, filed Aug. 10, 2021, the entire disclosure of which is hereby incorporated by reference.

FIELD

The present disclosure relates generally to systems and methods for providing modular building structures or "pods." More specifically, the present disclosure relates to methods and systems for evaluating the needs of certain pods based an installation areas with known or expected seismic activity, and providing one or more pods, pod structures, modifications, etc. based on site-specific conditions including but not limited to the seismic activity of the installation site.

BACKGROUND

Premanufactured structures for constructing buildings are known. For example, U.S. Pat. No. 9,382,709 to Collins et al., which is hereby incorporated by reference in its entirety, discloses premanufactured structures for multi-story buildings. Such structures provide various benefits including, for example, reduced time and work on-site wherein certain rooms (e.g. bathrooms) are constructed off site and are capable of being quickly inserted and installed into a larger construction project.

In general, however, known methods and systems fail to contemplate and provide premanufactured structures or "pods" that are site-specific and intended to withstand various environmental conditions at a particular geographic location of installation.

SUMMARY

Accordingly, there has been a long-felt and unmet need to provide methods and systems for forming, selecting, and providing pods that are adapted for use in a particular setting and to increase the overall safety and quality of pods and finished structures.

It is an object of the present disclosure to provide methods and systems for evaluating a project location, selecting certain pod(s) or pod characteristics based on the project location, and providing a pod structure that is customized in at least certain respects for a particular project and location. In some embodiments, methods and systems are provided wherein a pod installation location is evaluated for at least seismic activity and a probability that seismic events of certain magnitudes will occur at the location. Methods of these embodiments further contemplate providing at least this seismic information and at least one of selecting and modifying a pod's structure accordingly. It is further contemplated that various factors are determined and used to specify or select a pod's structure and details. Such factors include but are not limited to the floor or height at which the pod is to be installed, the pod's desired or required dimensions, and other structural properties of a building structure.

Pods of the present disclosure are not limited to any particular type of pod or intended use of the pod. While certain embodiments of the present disclosure contemplate pods that are constructed as bathroom units, the present disclosure is not limited to any particular pod type. One of ordinary skill in the art will recognize that systems and methods of the present disclosure are suitable for use with pods regardless of pod-type or the intended final use of the pod.

In one embodiment, a method of providing a modular building unit is provided. The method comprises determining a seismicity factor for a specific geographic location where the modular building unit is to be installed; determining an importance factor; determining a vertical position at which the modular building unit is to be installed; determining the weight and dimensions of the modular building unit; and based on at least two of the determining steps, determining structural design requirements for the modular building unit and modifying the modular building unit as needed.

In another embodiment, a method of providing a modular building unit is provided that comprises determining at least one of: a seismicity factor for a specific geographic location where the modular building unit is to be installed, an importance factor for a project, a vertical position at which the modular building unit is to be installed, a weight of the modular building unit, and the dimensions of the modular building unit; and providing a modular building unit; determining structural design requirements for the modular building unit based on at least one of the seismicity factor, the importance factor, the vertical position, the weight and the dimensions; comparing the structure of the modular building unit with the determined structural design requirements; and based on the comparing step, modifying the modular building unit prior to installation.

In various embodiments, methods and systems for securing a modular building unit are provided. In some embodiments, methods and systems for securing modular building units in limited or restricted access environments and situations are provided. For example, in certain embodiments, methods for securing a modular building unit in the form of an at least partially prefabricated room are provided. The methods and systems provided herein contemplate that least one corner or region of the unit is provided adjacent one or more walls including, for example, fire rated walls. In certain embodiments and applications including but not limited the installation of modular building units in areas of high seismic activity, it is desirable or required that modular building units be anchored or secured in a plurality of locations including, for example, all four corners of the unit. Embodiments of the present disclosure contemplate at least one corner of a building unit is provided against a wall and/or in a corner such that access to at least the sides and bottom of the unit is not easily accessible. Embodiments of the present disclosure therefore provide for novel anchoring systems wherein a building unit is secured from beneath the unit and/or a substrate beneath the unit. Further embodiments contemplate anchorage of a building unit from above the unit using bracing above the unit.

In one embodiment, a method of installing a modular building unit is provided. The method comprises providing a prefabricated modular building unit; positioning the prefabricated modular building unit on a substrate and proximal to at least one wall; and securing the prefabricated modular building unit by providing an anchor extending through at least a portion of the prefabricated modular building unit and through the substrate.

In another embodiment, a method of providing a modular building unit is provided that comprises: determining a first site-specific condition; determining a second site-specific condition; providing a modular building unit; based on the first site-specific condition and the second site-specific condition, determining anchorage requirements for the modular building unit; positioning the prefabricated modular building unit on a substrate and proximal to at least one wall; and based on the determined anchorage requirements, anchoring the prefabricated modular building unit by providing an anchor extending through at least a portion of the prefabricated modular building unit and through the substrate.

In one embodiment, a prefabricated modular building unit assembly is provided, the assembly comprising: a prefabricated modular building unit; a substrate operable to receive and support at least a portion of the prefabricated modular building; wherein a lower surface of the prefabricated modular building unit comprises at least one of a hold down and an aperture; and an anchor member extending through the lower surface of the prefabricated modular building unit and the substrate, wherein a portion of the anchor member is accessible from beneath the substrate such that a need to secure the unit to the wall(s) is obviated and the system is devoid of wall-based anchorage.

The Summary of the Invention is neither intended nor should it be construed as being representative of the full extent and scope of the present disclosure. The present disclosure is set forth in various levels of detail in the Summary as well as in the attached drawings and the Detailed Description and Appendix A. No limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosure.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
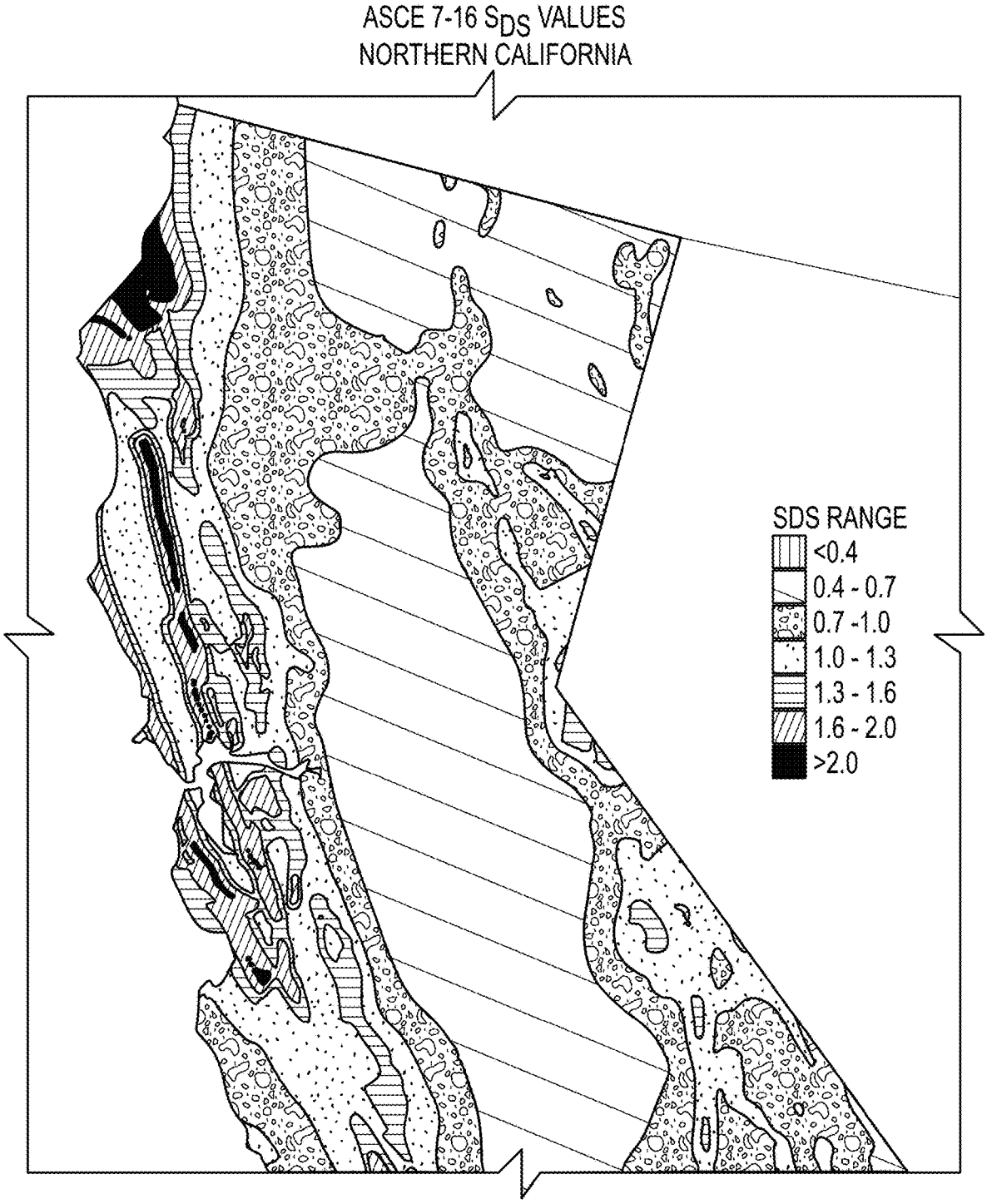

FIG. 1 is a map showing seismicity values based on geographic location.

Figure 2:
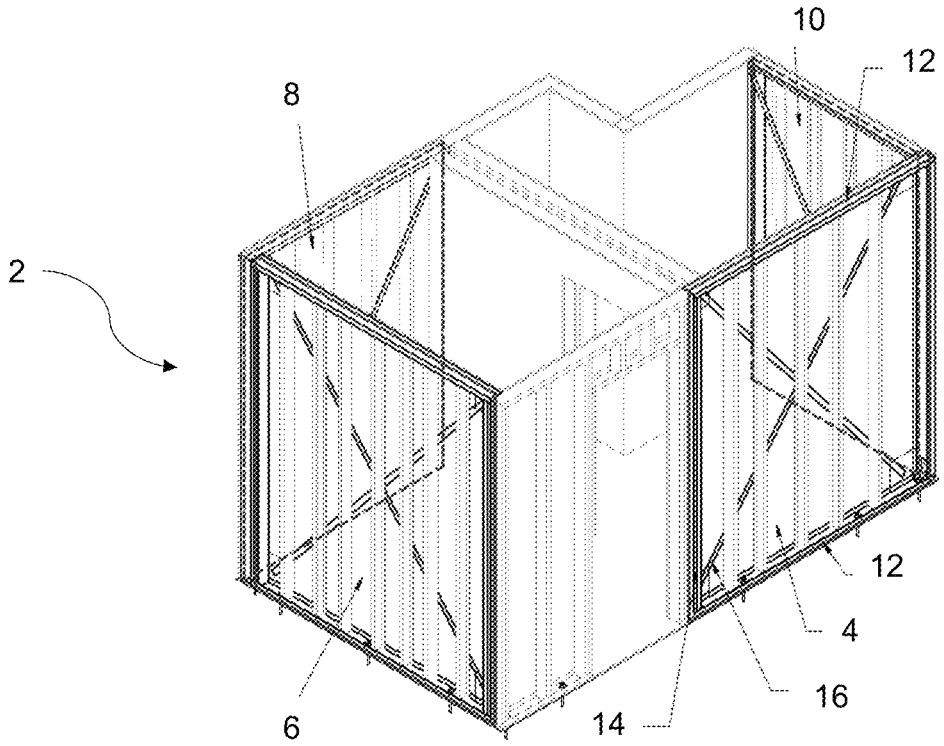

FIG. 2 is a perspective view of a pod according to one embodiment of the present disclosure.

Figure 3:
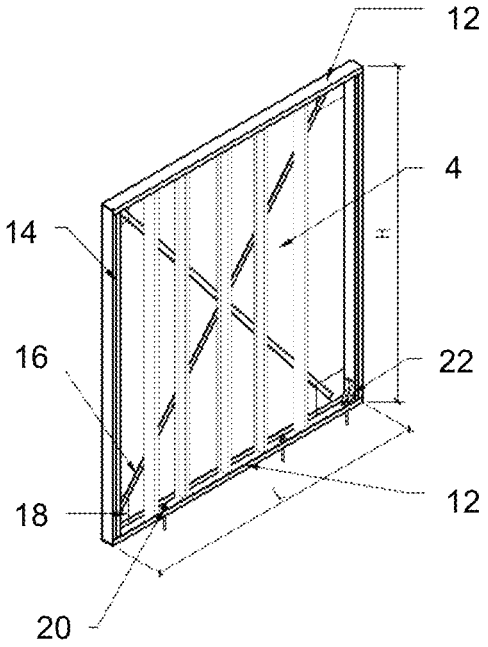

FIG. 3 is a perspective view of a component of a pod according to one embodiment of the present disclosure.

Figure 4:
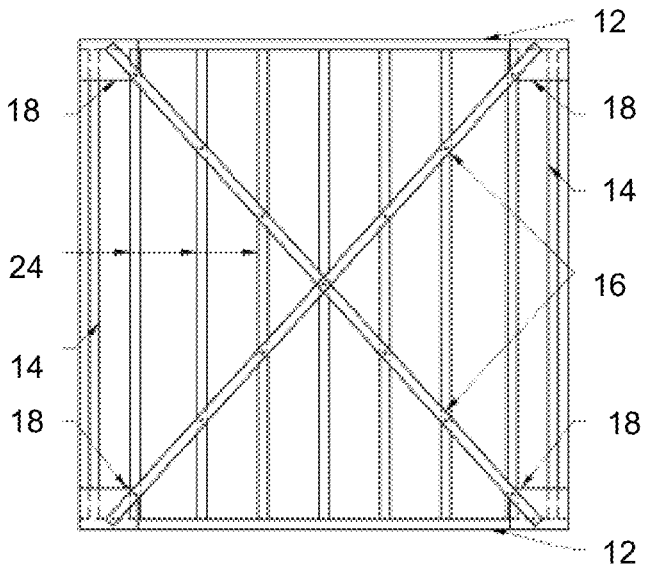

FIG. 4 is an elevation view of a component of a pod according to one embodiment of the present disclosure.

Figure 5:
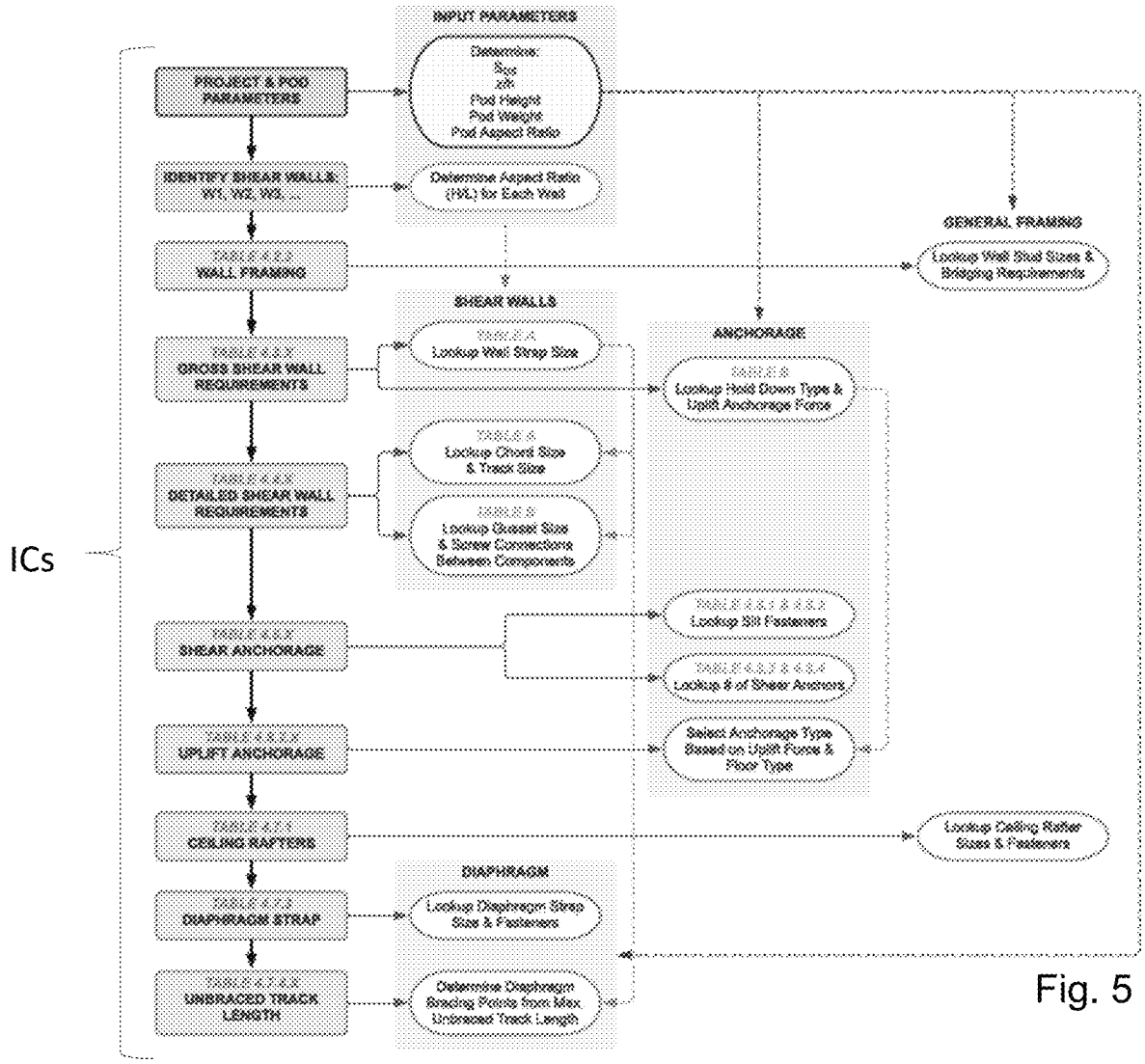

FIG. 5 is a flowchart of a process and method according to one embodiment of the present disclosure.

Figure 6:
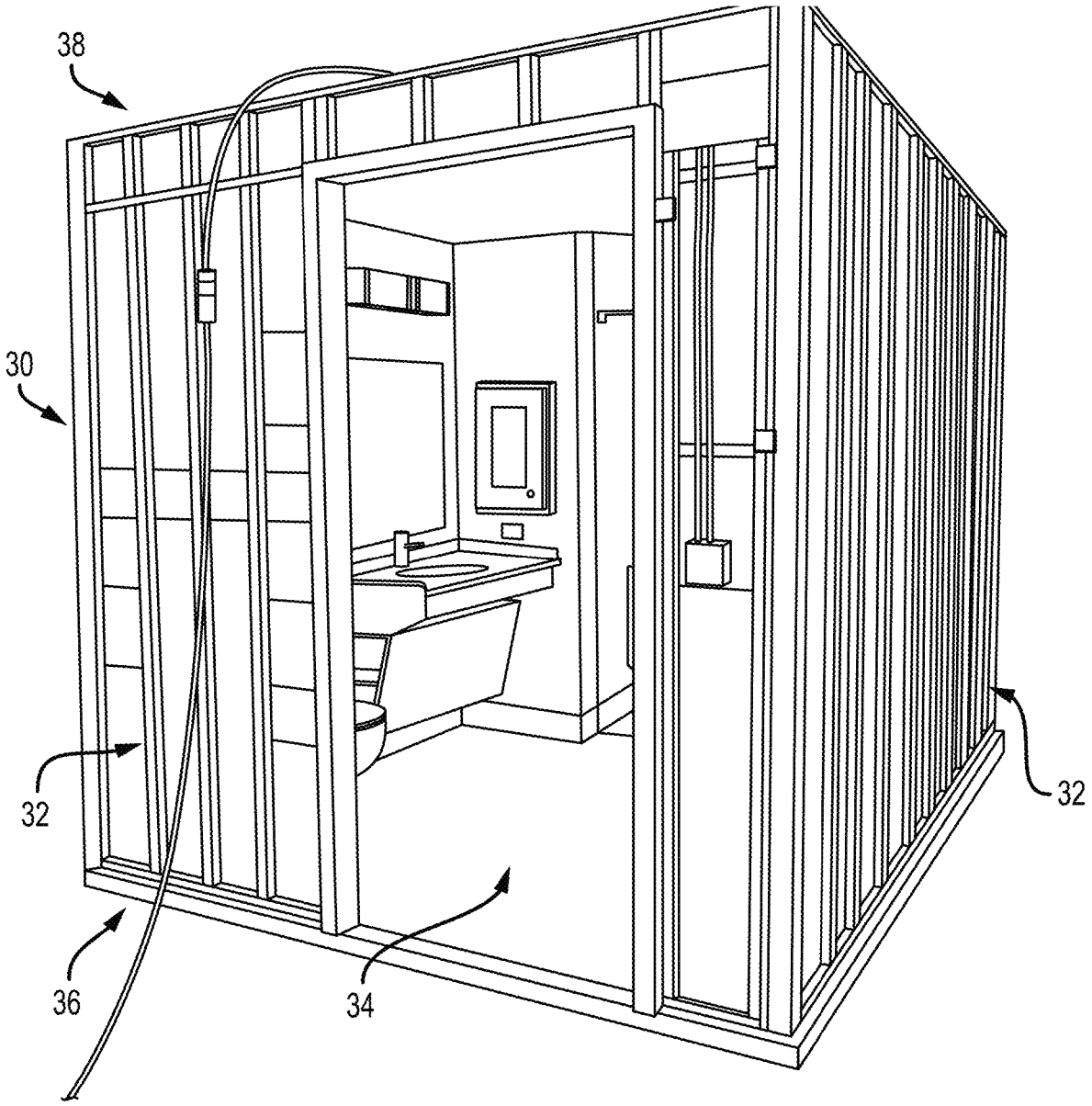

FIG. 6 is a perspective view of a modular building unit according to embodiments of the present disclosure.

Figure 7:
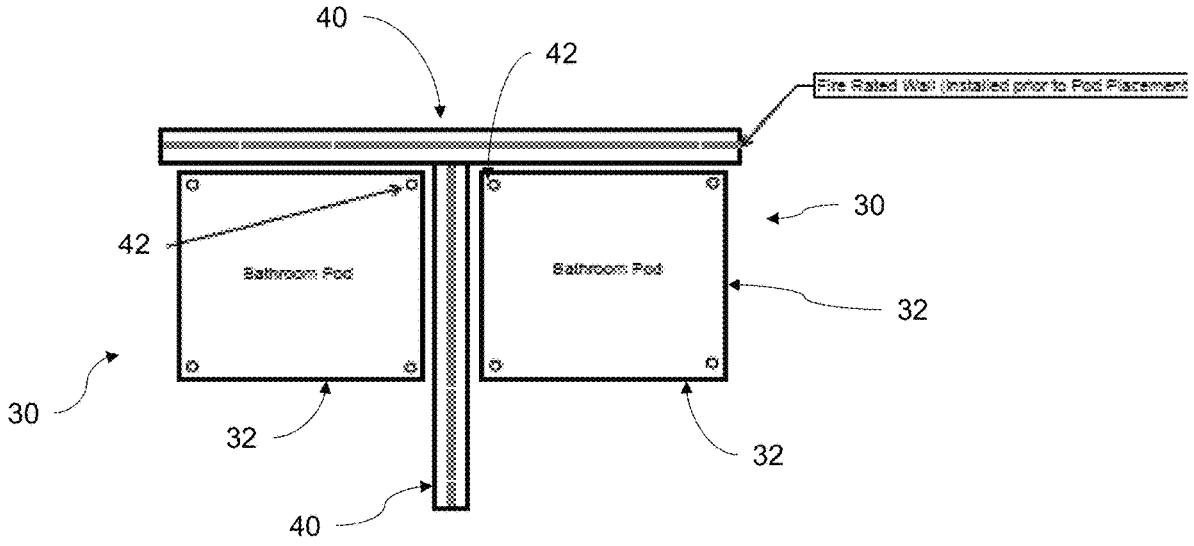

FIG. 7 is a top plan view of a modular building unit installation and wall form structures according to embodiments of the present disclosure.

Figure 8:
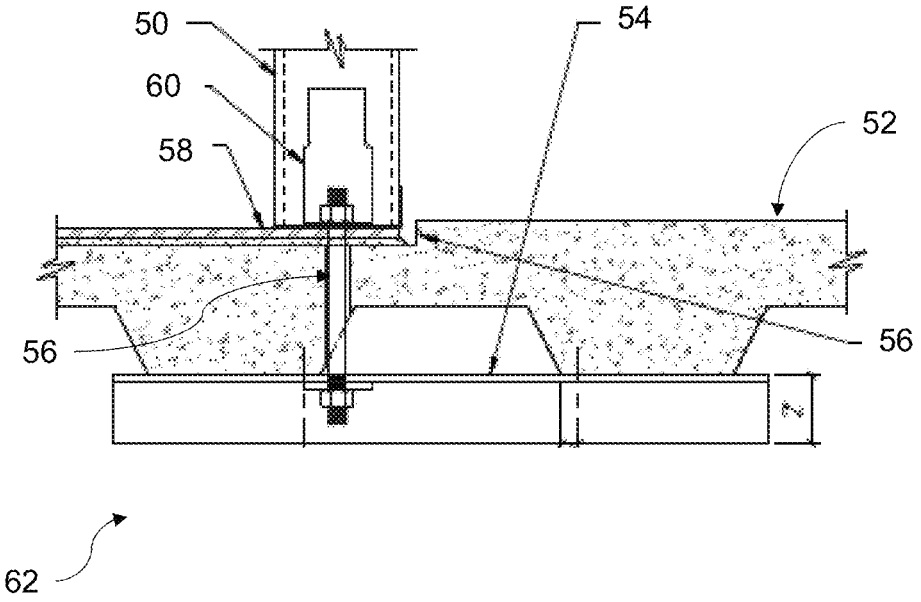

FIG. 8 is a cross-sectional elevation view of an anchorage system according to an embodiment of the present disclosure.

Figure 9:
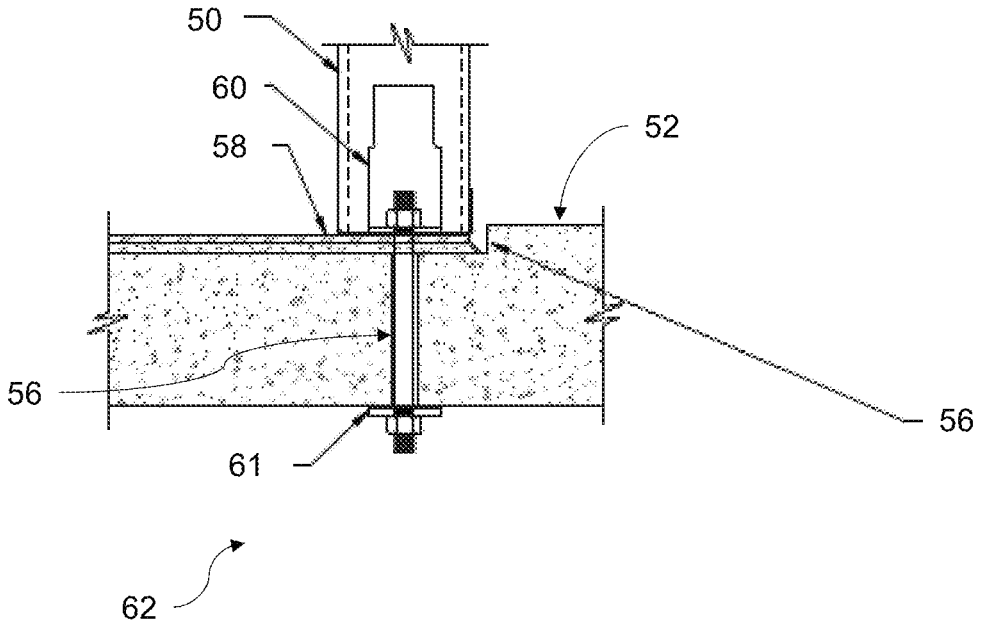

FIG. 9 is a cross-sectional elevation view of an anchorage system according to an embodiment of the present disclosure.

Figure 10:
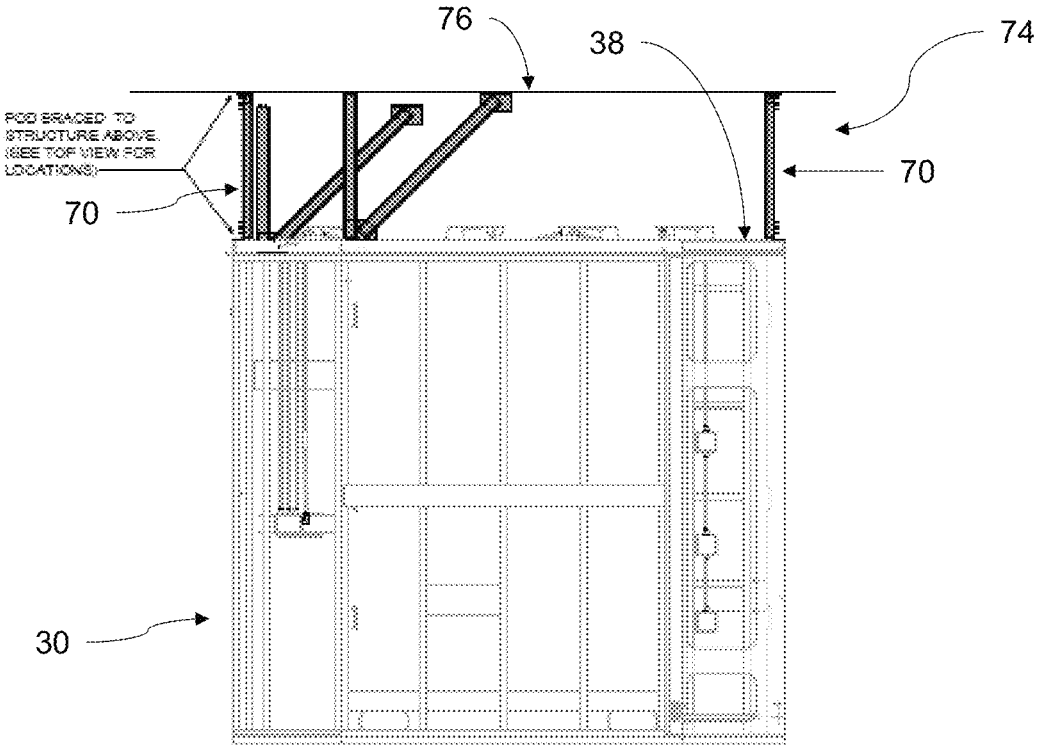

FIG. 10 is an elevation view of an anchorage system according to an embodiment of the present disclosure.

Figure 11:
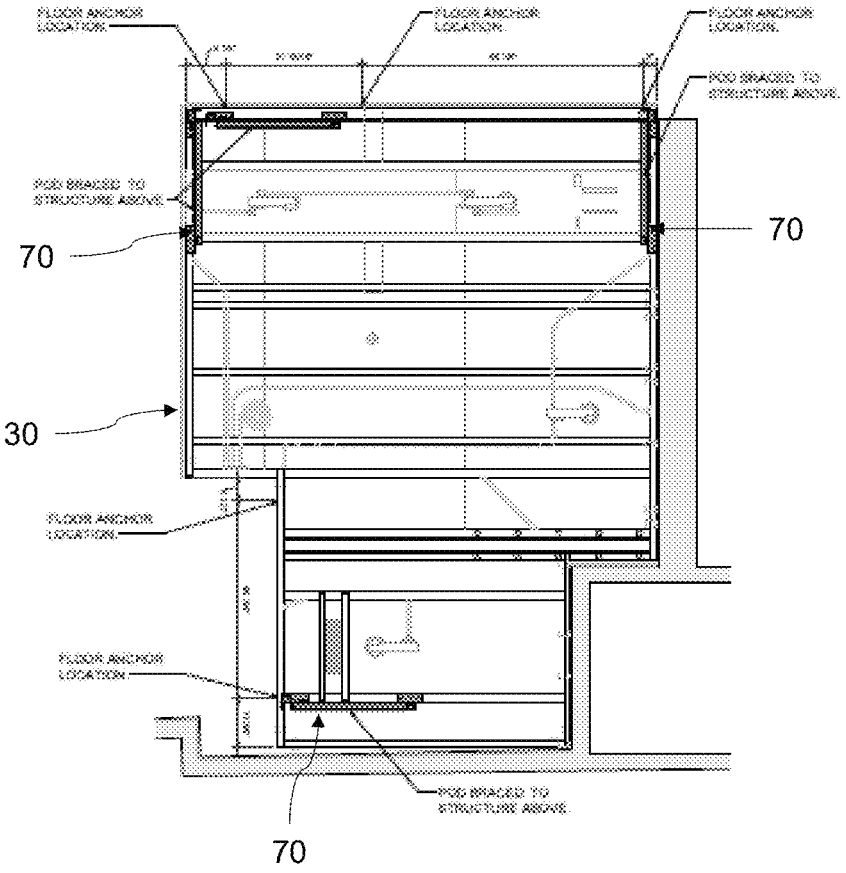

FIG. 11 is a top plan view of an anchorage system according to an embodiment of the present disclosure.

Figure 12:
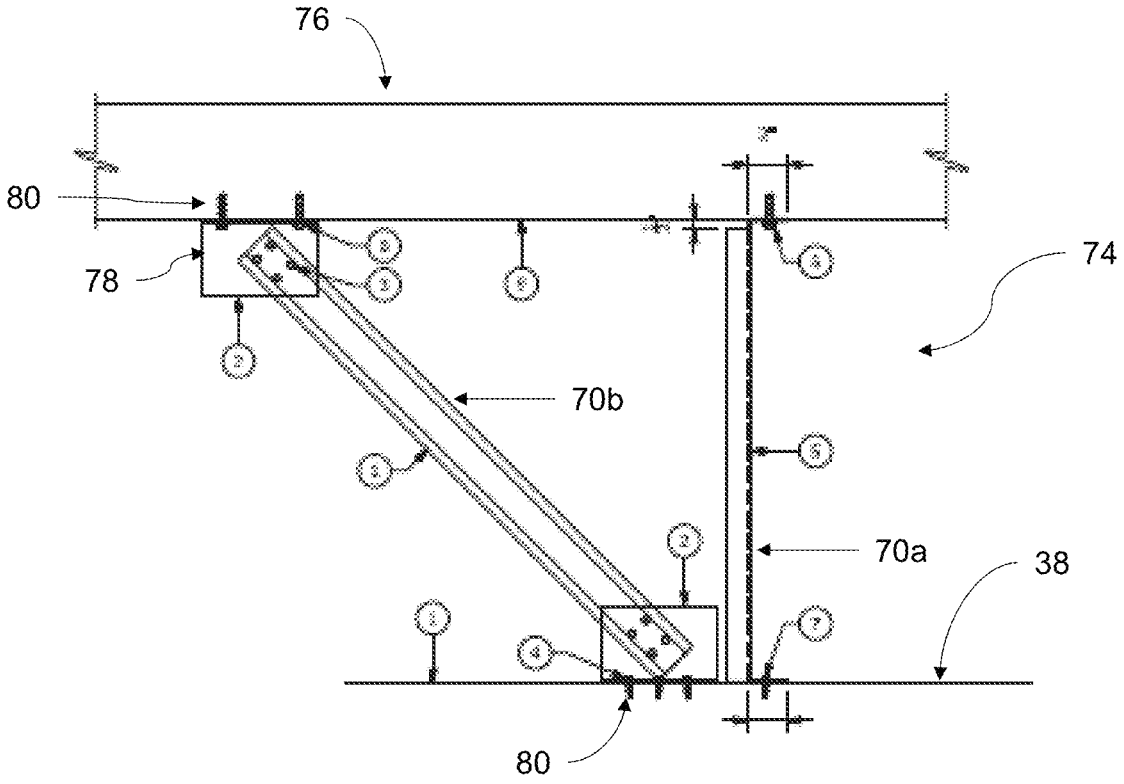

FIG. 12 is a side elevation view of an anchorage system according to an embodiment of the present disclosure.

Appendix A provides additional description of embodiments, features, systems and methods of the present disclosure and is hereby incorporated by reference in its entirety.

DETAILED DESCRIPTION

FIG. 1 is a map of specific geographic area with seismicity information. Specifically, a portion of the western United States is provided, and seismicity ranges and values are indicated. The information provided in FIG. 1 comprises preexisting information that is known to be provided by various reliable sources including, for example, the United States Geological Survey. Embodiments of the present disclosure contemplate using such information including, for example, that shown in FIG. 1 to determine the seismicity and likelihood and severity of seismic events at specific geographic locations in which one or more pods are to be installed. The information in FIG. 1 (for example) is contemplated for use with methods and embodiments of the present disclosure including as shown and described herein and as detailed in Appendix A.

FIG. 2 is a perspective view of a pod 2 according to one embodiment of the present disclosure. The present disclosure contemplates methods of evaluating, modifying and installing pods of various types, shapes and sizes. The pod 2 of FIG. 2 is provided for illustrative purposes and no limitation with respect to a particular pod is provided. As shown, the pod 2 of FIG. 2 comprises shear walls 4, 6, 8, 10, tracks 12, chords 14, and straps 16. The pod 2 generally comprises a prefabricated building unit such as a prefabricated bathroom that can be manufactured at a remote location and quickly installed into a larger construction project or structure. Embodiments of the present disclosure contemplate providing and/or modifying various pod components based on the methods disclosed herein. For example, the number, size, and location of straps 16 may be determined based on certain factors including, for example, seismicity, importance factor or factor of safety, pod installation height, pod dimensions, pod weight, and various combinations thereof. Based on such determination, it may either be confirmed that the pod is in compliance and ready for installation or one or more pods may be modified (e.g. straps may be added, replaced, modified, etc.).

While various embodiments of the present disclosure contemplate evaluating and modifying an existing pod based on site-specific conditions, it is also contemplated that the methods and processes of the present disclosure can be applied to initial pod construction. For example, a pod may be assembled at a factory in a remote location (for example) based on various site-specific considerations. It is also contemplated that pods are modified in the field and just prior to installation.

FIG. 3 is a perspective view of a shear wall 4 contemplated for use in a pod and with various features of the shear wall illustrated. FIG. 3 further includes references to tables (e.g. Table 4.3.X for the straps) where requirements and details for certain components can be found based on site-specific and pod-specific factors. The tables referenced in FIG. 3 and other Figures are provided in Appendix A. The present disclosure and inventive methods and systems disclosed herein are not limited to the specific tables and specific values provided in Appendix A. Rather, Appendix A is provided to illustrate and disclose certain embodiments and values. No limitation with respect to the specific values is provided.

As shown in FIG. 3, a sheer wall 4 is contemplated as comprising one or more of tracks 12, chords 14, straps 16, gussets 18, anchors 20, and/or hold downs 22. Methods and systems of the present disclosure contemplate that one or more details of these features such as size, placement, strength properties, and other characteristics are determined with reference to a site-specific condition including, for example, a seismicity value of the physical location in which the installation is to occur.

FIG. 4 is a front elevation view of a shear wall 4 according to one embodiment of the present disclosure. As shown, the shear wall 4 of FIG. 4 is contemplated as comprising one or more of tracks 12, chords 14, straps 16, gussets 18, anchors 20, and/or wall studs 24.

FIG. 5 is a flowchart illustrating a method of providing a pod according to one embodiment of the present disclosure. As shown, a specific construction project is provided with a need or requirement for one or more pods to be installed. Various input parameters for at least one pod are determined. Specifically, a seismicity factor $S_{DS}$ is determined for a specific project. The seismicity factor is a numeric value that may be determined or obtained from various sources based on geographic location. Additionally, an importance factor, pod height, pod weight, and pod aspect ratio are determined. Using the appropriate tables and information provided in Appendix A, various structural design requirements are then determined including, for example, anchorage requirements, general framing requirements, strap and fastening requirements, are determined. If needed, the pod is modified or adjusted prior to installation of the pod. As shown in FIG. 5, various initial conditions (ICs) are provided and relied on to form a pod. The input parameters are contemplated as aiding the design and specification of a pod and, where needed, modifying a pod that is not in compliance or otherwise suitable for a specific site and geographic location.

Although embodiments of the present disclosure contemplate providing and modifying pods for seismic activity, the present invention is not limited to seismicity considerations. It is contemplated, for example, that the inventive concepts, methods and system disclosed herein may be provided with various site-specific considerations including but not limited, flood risks, wind loads, traffic loading (e.g. for parking structures, bridges, etc.), and other factors. Accordingly, while various embodiments of the present disclosure contemplate specifying pods based on seismic considerations, inventive aspects of the present disclosure should not be viewed as limited to seismic considerations.

FIG. 6 depicts a modular building unit in the form of a prefabricated bathroom pod 30. As shown, the pod 30 comprises a plurality of walls 32, an access feature 34 (e.g. a doorway), a floor structure 36, and a ceiling structure 38. The pod 30 is contemplated as and intended to be installed into a larger structure and wherein at least portions of the external surfaces of the walls 32, floor structure 36, and ceiling structure 38 are flush against and/or rendered inaccessible by their proximity to additional building elements. Such building elements include, for example, vertical walls and horizontal ceilings and floors above and/or below the pod 30.

FIG. 7 is a top plan view of a pod installation arrangement wherein first and second pods 30 are provided relative to walls 40. While no limitation is provided with respect to the type, size, arrangement and/or features of the walls 40, it is contemplated in some embodiments that the walls 40 prevent anchorage of the pod(s) 30 directly to the wall(s). For example, one or more of the depicted walls 40 are contemplated as comprising a fire-rated wall with features, layers, or treatments that are not to be disturbed by anchorage or fasteners. Accordingly, in at least some embodiments, it is contemplated that the pod(s) must be secured without anchoring directly to the wall(s) (e.g. from inside the pod). It is further contemplated that pods either should or must (per various regulations) be anchored at specific locations including, for example, at all four corners of the pod. As shown in FIG. 7, each of the depicted pods 30 comprises at least one interior corner 42 to which access is restricted or prevented. The pods 30 are placed against the walls 40 in their intended and final location. In certain applications including, for example, installations in areas of high seismic activity, it may be advantageous and/or necessary to anchor the pod at the interior corners 42. However, anchorage through the walls of the pod and to the walls 40 is not permitted due to the fire-rated nature of the walls and/or other factors. Embodiments of the present disclosure thus contemplate securing the pod with at least one anchor that extends through or into a substrate and/or anchoring the pod between a ceiling of the pod and a structure or surface above the pod as will be shown and described herein.

FIG. 8 is a cross-sectional elevation view of an anchoring arrangement system and method according to an embodiment of the present disclosure contemplated for use with modular building units and other structures. As shown, a wall stud 50 of a pod is shown relative to a substrate that comprises a concrete layer 52 and a metal decking member 54. The concrete layer 52 is contemplated as comprising a depression 56 that may be specified or dimensioned based on a specific project. A floor plate 58 is further completed as being provided between the wall stud 50. A through-bolt 56 or similar fastener is provided that extends through a floor plate 58, the concrete layer 52 and the metal decking 54. Respective ends of the through-bolt 56 are contemplated as comprising nuts or similar fasteners and are accessible via a hold down 60 in the stud 50 and from beneath the assembly including, for example, from a floor or space 62 beneath the pod. The upper portion of the bolt 56 is accessible from inside the pod (for example) and the lower portion of the bolt 56 is accessible from the space 62 beneath the pod. Accordingly, at least an interior corner portion of the pod can be secured to the substrate and a need to anchor the interior or hidden corner to a wall is eliminated.

FIG. 9 is a cross-sectional elevation view of an anchoring system arrangement according to an embodiment of the present disclosure. As shown, a wall stud 50 of a pod is shown relative to a substrate that comprises a concrete layer or floor slab 52. The concrete layer 52 is contemplated as comprising a depression 56 that may be specified or dimensioned based on a specific project. A floor plate 58 is further completed as being provided beneath the wall stud 50. The floor plate 58 may comprise a portion or element of a pod. A through-bolt 56 or similar fastener is provided that extends through the floor plate 58 and the concrete layer 52.

Respective ends of the through-bolt 56 are contemplated as comprising nuts and washers 61 or similar fasteners and are accessible via a hold down 60 (e.g. a bracket) and the stud 50 and from beneath the assembly including, for example, from a floor or space 62 beneath the pod. The upper portion of the bolt 56 is accessible from inside the pod (for example) and the lower portion of the bolt 56 is accessible from the space 62 beneath the pod. Accordingly, at least an interior corner portion of the pod can be secured to the substrate and a need to anchor the interior or hidden corner to a wall is eliminated.

Although certain features and materials are depicted in FIGS. 8-9, it will be recognized that methods and systems of the present disclosure are not limited to such materials and inventive aspects of the present disclosure are not limited to features shown in FIGS. 8-9. For example, methods and systems of anchoring a structure at a blind or inaccessible corner according to the present disclosure are contemplated for use with various applications and are not limited to modular building unit installations, concrete substrates, or any other specific feature or material. For example, it is contemplated that methods and system disclosed herein may be useful for installing pods, fixtures, decorative elements, framed walls (apart from a prefabricated building pod), studs, singular beams (in various orientations), and the like. Additionally, no limitation is provided with respect the substrate. Anchoring systems and methods shown and described herein are contemplated for use with wood frame members, concrete, steel elements, rock, etc.

FIG. 10 is an elevation view of a pod 30 secured in a final location within a larger structure at least in part due to the provision of bracing members 70 provided in a headspace 74 between an upper portion 38 of the pod 30 and a ceiling member 76 and/or region above the pod 30. The system and arrangement of FIG. 10 is contemplated as being provided as an alternative to the anchorage system of FIGS. 8-9 but is also contemplated as being provided in combination with the systems and methods of FIGS. 8-9. The systems and disclosed herein are not mutually exclusive.

FIG. 11 is a top plan view of a pod 30 and anchorage system according to the embodiment of FIG. 10. As shown, the pod 30 is secured from above by the provision of one or more anchor and preferably a plurality of anchors 70 between an upper portion 38 of the pod 30 and a ceiling structure immediately above the pod 30. As shown in FIG. 11, a plurality of braces 70 are provided to secure the pod in multiple locations. No upper limit to the number of braces is provided, as the pod 30 may be secured based on various needs and conditions including, for example, the arrangement of surrounding walls, and/or seismic conditions of the installation location.

FIG. 12 is an elevation view of a bracing system according to an embodiment of the present disclosure. As shown, an upper portion 38 of a pod is provided. A structural slab 76 (e.g. a floor slab above the pod) is provided and a headspace is provided between the upper portion 38 of the pod and the slab 76. Structural braces 70*a*, 70*b* are provided to secure the pod in a desired location without the need to tamper with or anchor into wall panels. A first brace 70*a* is contemplated as comprising a vertical brace, and a second brace 70*b* is contemplated as comprising a diagonal brace. The braces 70*a*, 70*b* are contemplated as being secured to the upper portion 38 of the pod and/or the slab 76 by angle clips 78 and/or webbing and associated fasteners (e.g. screws).

While various embodiments of the present disclosure contemplate the provision of anchor bolts below the pod and bracing above the pod, it is further contemplated that bolts may extend upwardly through the upper portion of the pod and into the slab above the pod. Similarly, in certain embodiments, bracing can be provided beneath a pod extending between a pod and structure(s) beneath the pod to secure the pod in a final location.

In various embodiments, methods of securing a modular building unit are contemplate that comprise providing a prefabricated modular building unit, locating the modular building unit proximal to at least one wall, and providing at least one anchor between the modular building unit and the surrounding environment wherein the at least one anchor comprises a bolt extending through a portion of the modular building unit and a substrate and a brace extending between an upper portion of the building unit and a surface above the unit.

While various embodiments of the present disclosure have been described in detail, it is apparent that modifications and alterations of those embodiments will occur to those skilled in the art. However, it is to be expressly understood that such modifications and alterations are within the scope and spirit of the present disclosure. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A method of providing a prefabricated modular building unit, the method comprising:

determining a first site-specific condition;

determining a second site-specific condition;

providing the prefabricated modular building unit;

based on the first site-specific condition and the second site-specific condition, determining installation requirements for the prefabricated modular building unit;

positioning the prefabricated modular building unit on an underlying substrate and proximal to at least one fire-rated wall;

based on the determined installation requirements, determining at least one of an anchoring, framing, strapping, and a fastening requirement of the prefabricated modular building unit; and securing the prefabricated modular building unit by providing at least one of a strap, a brace, and an anchor extending through at least a portion of the prefabricated modular building unit and through the substrate, a structure, or a slab located adjacent the prefabricated modular building unit, wherein the first site-specific condition and the second site-specific condition are different.

2. The method of claim 1, wherein at least one of a strap, a brace, and an anchor is provided proximal to a blind corner of two walls.

3. The method of claim 1, further comprising providing at least one of an anchor and a brace between an upper portion of the modular building unit and a structure or slab above the prefabricated modular building unit.

4. The method claim 1, wherein a hole or aperture operable to receive an anchor is pre-formed in the substrate.

5. The method of claim 1, further comprising anchoring the prefabricated modular building unit by providing an anchor extending through at least a portion of the prefabricated modular building unit and through the substrate.

6. The method of claim 1, wherein the prefabricated modular building unit is provided proximal to at least one fire-rated wall panel and wherein the prefabricated modular building unit is secured to at least one of the substrate and a ceiling without anchorage to the at least one fire-rated wall panel.

7. The method of claim 1, wherein the first site-specific condition comprises a seismicity factor based on geographic location.

8. The method of claim 1, wherein the second site-specific condition comprises at least one of an importance factor and a factor of safety.

9. The method of claim 7, wherein when the seismicity value is of a predetermined value or higher, determining that multiple anchors are to be provided and securing the modular building unit by providing at least one of the multiple anchors extending through at least a portion of the prefabricated modular building unit and through the substrate.

10. The method of claim 1, wherein the first site specific condition comprises seismic information.

11. The method of claim 10, further comprising at least one of selecting and modifying the structure of the prefabricated modular building unit based on the seismic information.

* * * * *